US007320438B1

(12) United States Patent
Latin et al.

(10) Patent No.: US 7,320,438 B1
(45) Date of Patent: Jan. 22, 2008

(54) SHOWER HEAD FOR DISPENSING A MIXTURE OF WATER AND AT LEAST ONE BATHING GEL

(76) Inventors: Rendall H. Latin, 5517 Alderbrook Ct., Apartment 101, Rockville, MD (US) 20851; Rama Germilus, 5517 Alderbrook Ct., Apartment 101, Rockville, MD (US) 20851

( * ) Notice: Subject to any disclaimer, the term of this patent is extended or adjusted under 35 U.S.C. 154(b) by 375 days.

(21) Appl. No.: 11/046,016

(22) Filed: Jan. 31, 2005

(51) Int. Cl.
*B05B 7/26* (2006.01)

(52) U.S. Cl. ..... 239/310; 239/305; 239/307; 239/407; 239/413; 239/552; 239/588; 4/903

(58) Field of Classification Search ..... 239/74, 239/303, 304, 305, 307, 310, 315, 318, 407, 239/409, 413, 418, 525, 552, 588; 137/889, 137/893; 4/903
See application file for complete search history.

(56) References Cited

U.S. PATENT DOCUMENTS 3,612,404 A 10/1971 Vicari
3,917,172 A 11/1975 O'Hare
4,200,206 A * 4/1980 Chase et al. ..... 239/307
4,218,013 A 8/1980 Davison
4,432,105 A * 2/1984 Pitroda ..... 239/303
4,840,311 A 6/1989 Shamblin
4,881,575 A * 11/1989 Smith ..... 137/893
5,071,070 A * 12/1991 Hardy ..... 239/303
5,174,503 A * 12/1992 Gasaway ..... 239/525
D370,523 S 6/1996 Stierman
5,562,248 A 10/1996 Khalifka
D397,407 S 8/1998 Forbes
6,421,847 B2 * 7/2002 Berke et al. ..... 4/903

* cited by examiner

*Primary Examiner*—Steven J. Ganey

(57) ABSTRACT

An apparatus includes an inlet conduit that has a threaded coupling removably attachable to the water supply source. A housing is connected to the inlet conduit and includes spaced compartments for storing bathing gels. Each compartment includes an inlet port that is provided with an end cap positional thereon. Each compartment further includes a plurality of seals attached therein for limiting leakage of the bathing gels. An outlet conduit is attached to a lower portion of the housing and is pliable. The outlet conduit receives a mixed solution of water and bathing gels. The apparatus further includes a mechanism for regulating a quantity of the bathing gels that is dispensed and a mechanism for displaying a remaining quantity of the bathing gels.

13 Claims, 3 Drawing Sheets

SHOWER HEAD FOR DISPENSING A MIXTURE OF WATER AND AT LEAST ONE BATHING GEL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to shower heads and, more particularly, to a shower head for dispensing a mixture of water and at least one bathing gel.

2. Prior Art

The use of shower head attachments in association with shower heads is well known in the prior art to provide dispensing of various toiletries and the like. These dispensers have normally been of a relatively elaborate and expansive structure to limit their incorporation by users.

One prior art example sets forth an enlarged shower head for containment of a shower additive for use in association with the outlet of the shower, but is of a relatively cumbersome structure causing it to tamper with the desired configuration of the shower head outlet. This is inconvenient to the user and not very cost-effective. Another example sets forth a steam outlet head wherein an interior channel is associated with a reservoir for dispensing of a fragrance through the head by means of steam flow through the head. Unfortunately, the fragrance dispensed with the steam tends to dissipate into the air and not reach the user's body, as is intended, thus making the dispenser ineffective.

It is often desired by bathers to use bathing gels while taking a shower, however the manual dispensing of these gels is cumbersome and time consuming. Neither of the prior mentioned inventions provides an effective means for automatically dispensing and mixing a desired amount of bathing gel with a steady stream of water.

Accordingly, a need remains for a shower head for dispensing a mixture of water and at least one bathing gel in order to overcome the above-noted shortcomings. The present invention satisfies such a need by providing a shower head dispensing apparatus that is convenient to use, provides space-savings, is versatile in application, and is easy to install and use. Such a showerhead apparatus allows soap, shower gel, shampoo, or conditioner to be mixed with water, thus providing a user with a relaxing shower experience. The apparatus provides a user with a hands-free method of applying soap to the body, and shampoo and conditioner to the hair. As a result, this invention would be particularly beneficial to the elderly and others with limited mobility. Such an apparatus is useful in private residencies, as well as in hotels, hospitals, school gyms, and health clubs.

BRIEF SUMMARY OF THE INVENTION

In view of the foregoing background, it is therefore an object of the present invention to provide a shower head for dispensing a mixture of water and at least one bathing gel. These and other objects, features, and advantages of the invention are provided by an apparatus removably attachable to a water supply source for allowing a user to receive a stream of water mixed with at least one bathing gel.

The apparatus includes an inlet conduit that has a threaded coupling attached to a top end portion thereof and is removably attachable to the water supply source. Such an inlet conduit extends along a rigid path wherein a selected volume of water flows downstream therethrough.

A housing is integrally connected to the inlet conduit and includes a plurality of spaced compartments for conveniently storing alternate bathing gels. Such a housing further has a centrally disposed longitudinal axis bisecting the inlet conduit wherein the compartments are equidistantly spaced laterally away from the axis to thereby allow a stream of water to flow medially between the compartments prior to exiting the housing.

Each of the compartments includes an inlet port formed along a top surface thereof for receiving the bathing gels therethrough. Each inlet port is provided with a fitted end cap removably positional thereon for advantageously isolating the compartments from undesirable foreign elements during operating conditions. Each of the compartments further include a plurality of seals attached therein such that the seals cooperate with the regulating mechanism (described herein below) for advantageously limiting undesirable leakage of the bathing gels.

An outlet conduit is attached to a lower portion of the housing and is pliable. Such an outlet conduit receives a mixed solution of water and bathing gels such that the solution becomes generally homogenized upstream of the outlet conduit. The outlet conduit preferably includes a dispensing nozzle removably attached thereto. Such a dispensing nozzle has a plurality of spaced openings sized and shaped for allowing the homogonous solution to effectively exit the dispensing nozzle and thereby advantageously limit the likelihood of clogging the openings between repeated uses.

A mechanism is included for regulating a quantity of the bathing gels such that the user may conveniently selectively adjust a bathing gel:water ratio within the housing. The regulating mechanism preferably includes a pair of rotatable knobs protruding outwardly from the compartments that are selectively rotatable between on and off positions. A pair of flow valves is operably connected to the knobs wherein each valve is provided with an axial bore passing therethrough such that the valves define a continuous travel path downwardly through the compartments when the user rotates the knobs to the open position. Such axial bores are disposed horizontally and thereby effectively restrict the flow of the bathing gels downwardly through the compartments when the user rotates the knob to the off position. A plurality of chamfered gates are disposed subjacent to the valves wherein each chamfered gate can be selectively positioned along a pair of vertical planes extending substantially parallel to the axis such that a discharge rate of the bathing gels can conveniently be controlled within the compartments and selectively introduced into the water stream prior to exiting the housing.

Each of the compartments may be provided with an open lower edge portion medially facing the longitudinal axis. The chamfered gates are preferably slidably positional along the open lower edge portions and the regulating mechanism may further include a pair of levers extending outwardly from the compartments that are operably connected to the chamfered gates such that the user may advantageously readily adapt the chamfered gates between maximum and minimum positions.

The apparatus further includes a mechanism for effectively displaying a remaining quantity of the bathing gels such that the user can readily identify whether the compartments require an additional supply of the bathing gels. Such an identifying mechanism preferably includes a plurality of transparent windows fitted into an outer wall of the compartments and extending along a vertical plane such that the user may readily determine a remaining quantity of the bathing gels housed within the compartments.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
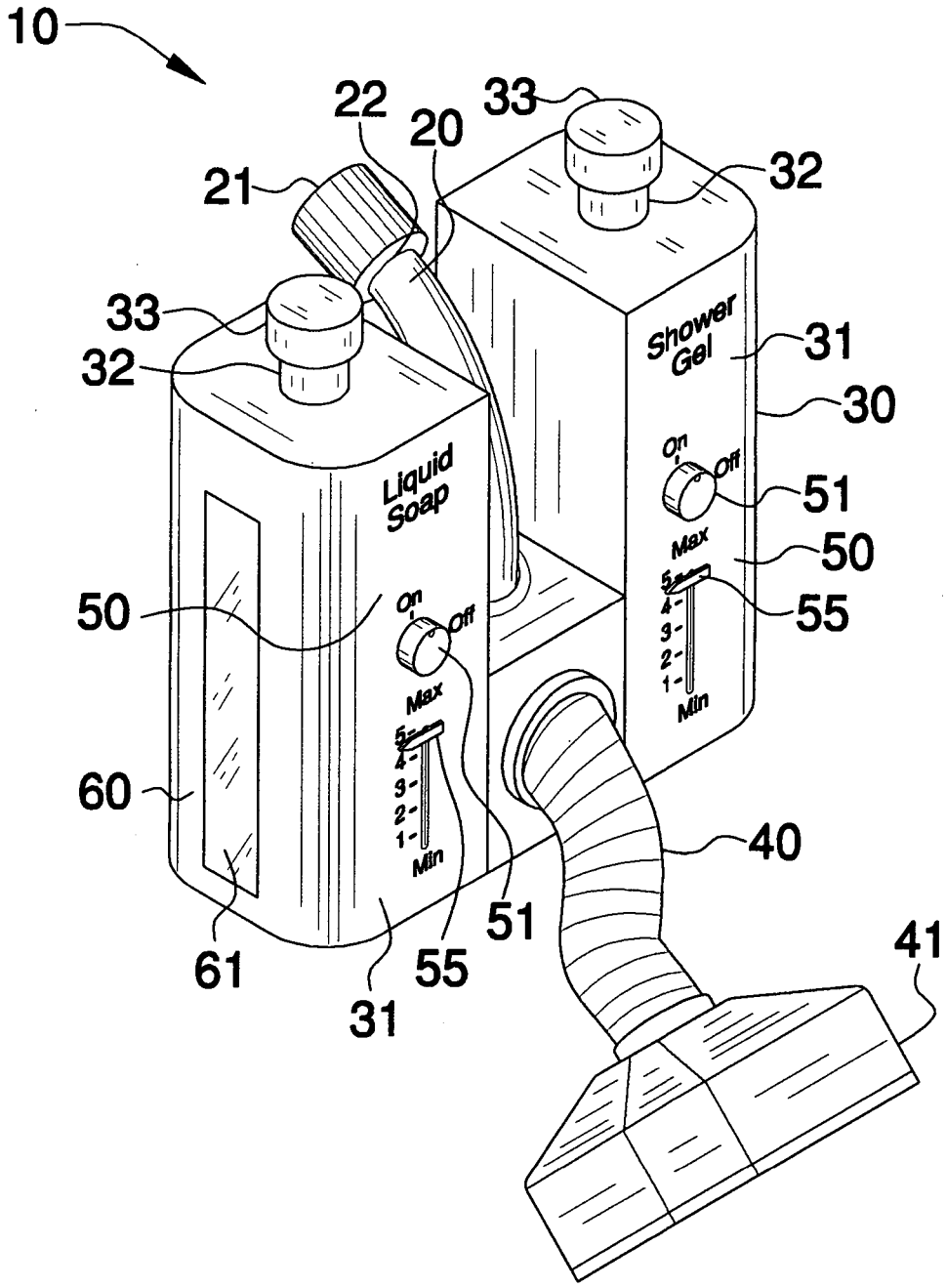
FIG. 1 is a perspective view showing a showerhead dispensing a mixture of water and at least one bathing gel, in accordance with the present invention.
Figure 2:
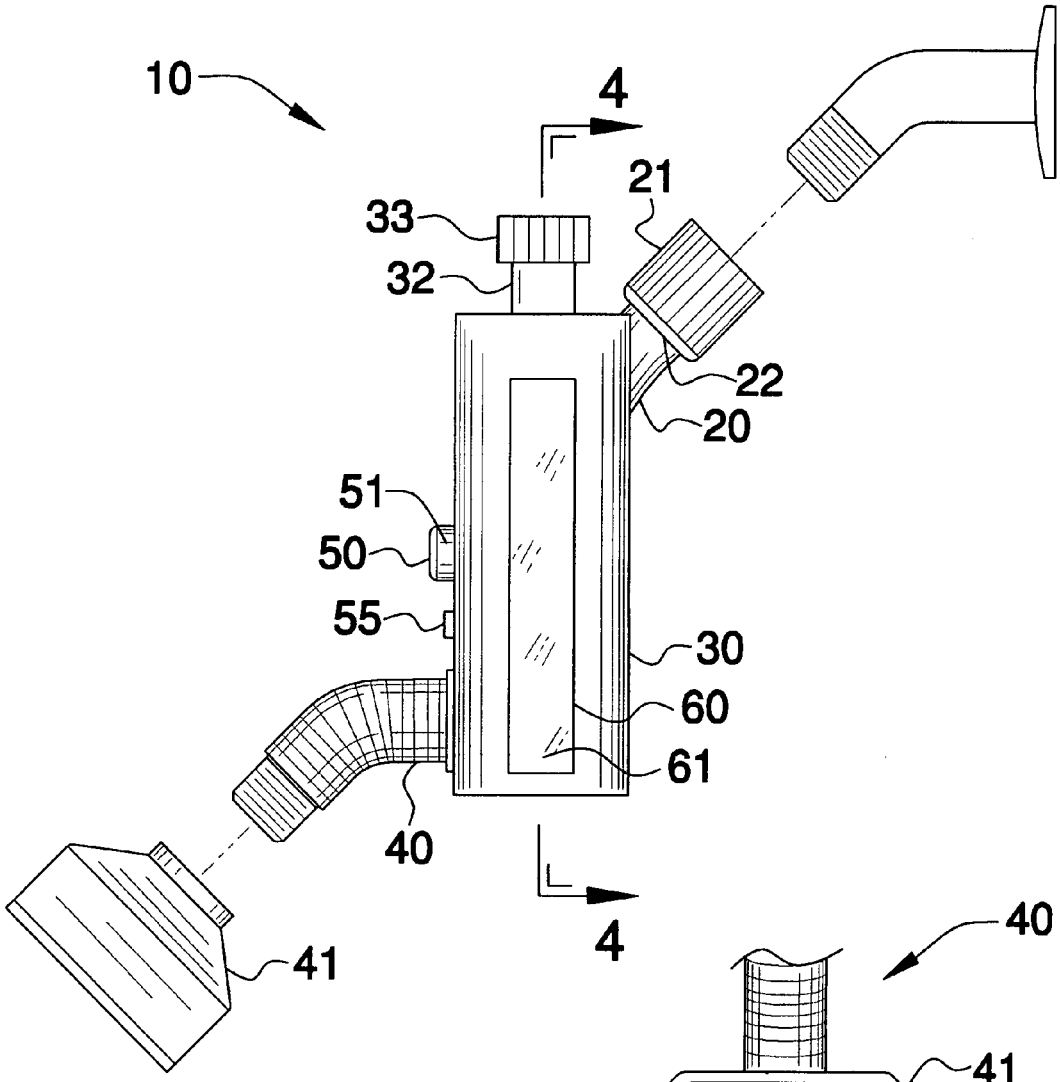
FIG. 2 is a partially exploded side elevational view of the apparatus shown in FIG. 1.
Figure 3:
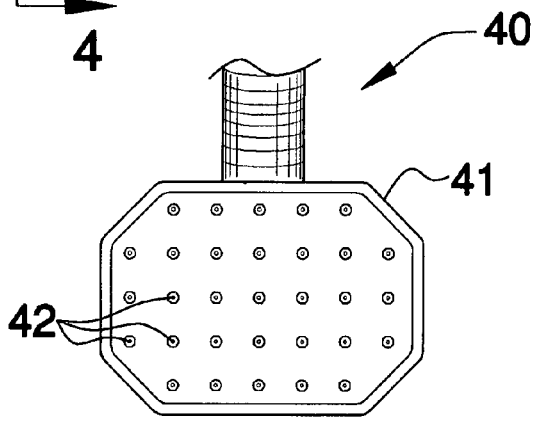
FIG. 3 is a bottom plan view of the dispensing nozzle shown in FIG. 2.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a showerhead dispensing a mixture of water and at least one bathing gel. It should be understood that the apparatus 10 may be used to dispense many different types of bathing fluids and should not be limited in use to only dispensing bathing gels.

Referring initially to FIG. 1, the apparatus 10 includes an inlet conduit 20 that has a threaded coupling 21 attached to a top end portion 22 thereof and is removably attachable to the water supply source, thus advantageously allowing the apparatus 10 to be transported from one water supply source to another. Such an inlet conduit 20 extends along a rigid path wherein a selected volume of water flows downstream therethrough.

Referring to FIGS. 1, 2, 4 and 5, a housing 30 is integrally connected to the inlet conduit 20 and includes a plurality of spaced compartments 31 for conveniently storing alternate bathing gels. Such a housing 30 further has a centrally disposed longitudinal axis bisecting the inlet conduit 20 wherein the compartments 31 are equidistantly spaced laterally away from the axis to thereby allow a stream of water to flow medially between the compartments 31 prior to exiting the housing 30. Of course, the housing 30 and its associated compartments 31 may be produced in a variety of different shapes, sizes and colors, as is obvious to a person of ordinary skill in the art.

Still referring to FIGS. 1, 2, 4, and 5, each of the compartments 31 includes an inlet port 32 formed along a top surface thereof for receiving the bathing gels therethrough. Each inlet port 32 is provided with a fitted end cap 33 removably positional thereon for advantageously isolating the compartments 31 from undesirable foreign elements during operating conditions. Each of the compartments 31 further includes a plurality of seals 34 attached therein such that the seals 34 cooperate with the regulating mechanism (described herein below) for advantageously limiting undesirable leakage of the bathing gels.

Referring to FIGS. 1, 2, 3 and 5, an outlet conduit 40 is attached to a lower portion of the housing 30 and is pliable. Such an outlet conduit 40 receives a mixed solution of water and bathing gels such that the solution becomes generally homogenized upstream of the outlet conduit 40. The outlet conduit 40 includes a dispensing nozzle 41 removably attached thereto. Such a dispensing nozzle 41 has a plurality of spaced openings 42 sized and shaped for allowing the homogonous solution to effectively exit the dispensing nozzle 41 and thereby advantageously limit the likelihood of clogging the openings 42 during repeated uses.

Referring to FIGS. 1, 2, 4 and 5, a mechanism 50 is included for regulating a quantity of the bathing gels such that the user may conveniently selectively adjust a bathing gel:water ratio within the housing 30. The regulating mechanism 50 includes a pair of rotatable knobs 51 protruding outwardly from the compartments 31 that are selectively rotatable between on and off positions. A pair of flow valves 52 are operably connected to the knobs 51 wherein each valve 52 is provided with an axial bore 53 passing therethrough such that the valves 52 define a continuous travel path downwardly through the compartments 31 when the user rotates the knobs 51 to the open position. Such axial bores 53 are disposed horizontally and thereby effectively restrict the flow of the bathing gels downwardly through the compartments when the user rotates the knobs 51 to the off position.

Selective positioning of the knobs 51 conveniently allows a user to dispense one or a plurality of bathing gels simultaneously, thereby increasing the versatility of the apparatus 10. A plurality of chamfered gates 54 are disposed subjacent to the valves 52 wherein each chamfered gate 54 can be selectively positioned along a pair of vertical planes extending substantially parallel to the axis such that a discharge rate of the bathing gels can conveniently be controlled within the compartments 31 and selectively introduced into the water stream prior to exiting the housing 30.

Figure 5:
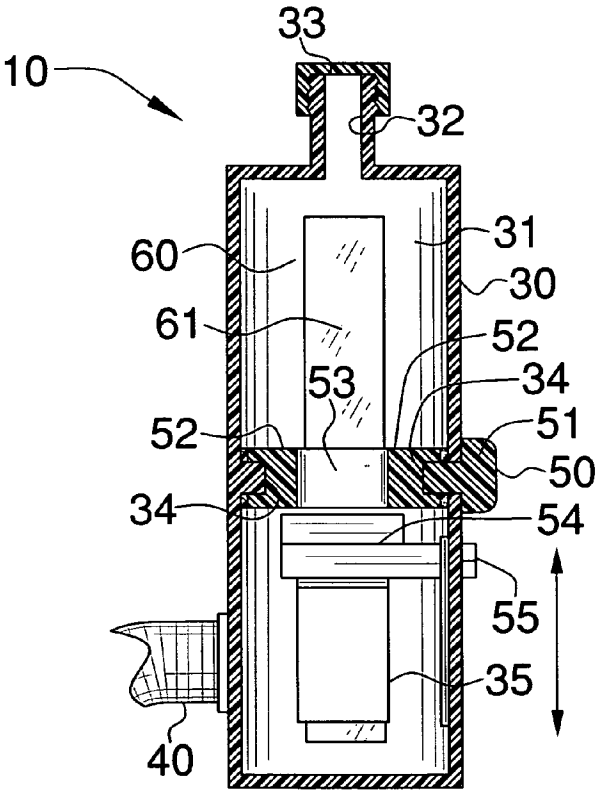
FIG. 5 is a cross-sectional view of the apparatus shown in FIG. 4, taken along line 5-5 and showing the various operational and non operational positions of the flow valves and the chamfered gates.
Figure 4:
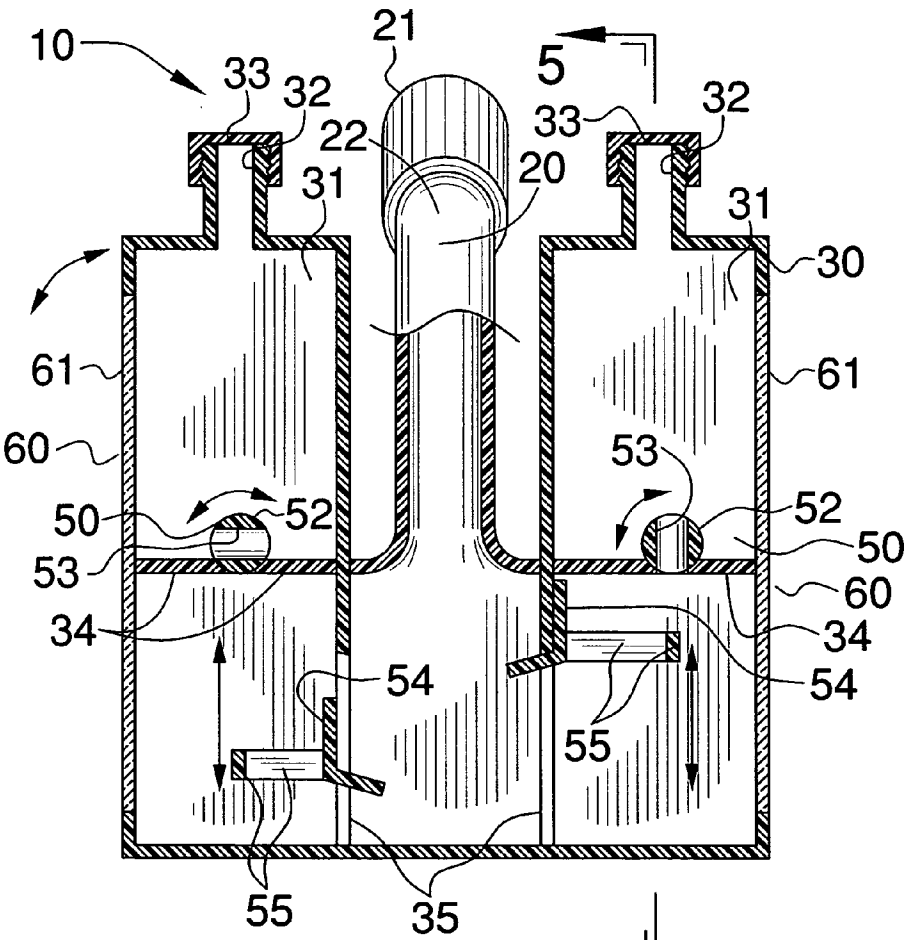
FIG. 4 is a cross-sectional view of the apparatus shown in FIG. 2, taken along line 4-4.

Referring to FIGS. 4 and 5, each compartment 31 is provided with an open lower edge portion 35 medially facing the longitudinal axis. The chamfered gates 54 are slidably positional along the open lower edge portions 35. The regulating mechanism 50 further includes a pair of levers 55 extending outwardly from the compartments 31 that are operably connected to the chamfered gates 54 such that the user may advantageously readily adapt the chamfered gates 54 between maximum and minimum positions. Adjusting the chamfered gates 54 effectively allows the user to control the amount of water that mixes with the bathing gels and further allows the user to select simultaneous or separate mixing of bathing gels.

Referring to FIGS. 1, 2, 4 and 5, the apparatus 10 further includes a mechanism 60 for effectively displaying a remaining quantity of the bathing gels such that the user can readily identify whether the compartments 31 require an additional supply of the bathing gels. Such an identifying mechanism 60 includes a plurality of transparent windows 61 fitted into an outer wall of the compartments 31 and extending along a vertical plane such that the user may readily determine a remaining quantity of the bathing gels housed within the compartments 31. This feature advantageously prevents a user from running out of bathing gels during use of the apparatus 10, which would result in an unsatisfying showering experience.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus removably attachable to a water supply source for allowing a user to receive a stream of water mixed with at least one bathing gel, said apparatus comprising:

a inlet conduit having a threaded coupling attached to a top end portion thereof and being removably attachable to the water supply source, said inlet conduit extending along a rigid path wherein a selected volume of water flows downstream therethrough;

a housing integrally connected to said inlet conduit and including a plurality of spaced compartments for storing alternate bathing gels, said housing further having a centrally disposed longitudinal axis bisecting said inlet conduit wherein said compartments are equidistantly spaced laterally away from the axis to thereby allow a stream of water to flow medially between said compartments prior to exiting said housing;

an outlet conduit attached to a lower portion of said housing, said outlet conduit receiving a mixed solution of water and bathing gels such that the solution becomes generally homogenized upstream said outlet conduit;

means for regulating a quantity of the bathing gels such that the user may selectively adjust a bathing gel:water ratio within said housing; and means for displaying a remaining quantity of the bathing gels such that the user can readily identify whether said compartments require an additional supply of the bathing gels;

wherein said regulating means comprises:

a pair of rotatable knobs protruding outwardly from said compartments and being selectively rotatable between on and off positions;

a pair of flow valves operably connected to said knobs wherein each said valve is provided with an axial bore passing therethrough such that said valves define a continuous travel path downwardly through said compartments when the user rotates said knobs to the open position, said axial bores being disposed horizontally and thereby restricting the flow of the bathing gels downwardly through said compartments when the user rotates said knob to the off position; and a plurality of chamfered gates disposed subjacent said valves wherein each said chamfered gate can be selectively positioned along a pair of vertical planes extending substantially parallel to the axis such that a discharge rate of the bathing gels can be controlled within said compartments and selectively introduced into the water stream prior to exiting said housing.

2. The apparatus of claim 1, wherein each said compartment is provided with an open lower edge portion medially facing the longitudinal axis, said chamfered gates being slidably positional along said open lower edge portions;

said regulating means further comprising a pair of levers extending outwardly from said compartments and operably connected to said chamfered gates such that the user may readily adapt said chamfered gates between maximum and minimum positions.

3. The apparatus of claim 1, wherein said identifying means comprises: a plurality of transparent windows fitted into an outer wall of said compartments and extending along a vertical plane such that the user may readily determine a remaining quantity of the bathing gels housed within said compartments.

4. The apparatus of claim 1, wherein said outlet conduit comprises: a dispensing nozzle removably attached thereto, said dispensing nozzle having a plurality of spaced openings sized and shaped for allowing the homogonous solution to effectively exit said dispensing nozzle and thereby limit the likelihood of clogging said openings between repeated uses.

5. An apparatus removably attachable to a water supply source for allowing a user to receive a stream of water mixed with at least one bathing gel, said apparatus comprising:

a inlet conduit having a threaded coupling attached to a top end portion thereof and being removably attachable to the water supply source, said inlet conduit extending along a rigid path wherein a selected volume of water flows downstream therethrough;

a housing integrally connected to said inlet conduit and including a plurality of spaced compartments for storing alternate bathing gels, said housing further having a centrally disposed longitudinal axis bisecting said inlet conduit wherein said compartments are equidistantly spaced laterally away from the axis to thereby allow a stream of water to flow medially between said compartments prior to exiting said housing;

an outlet conduit attached to a lower portion of said housing, said outlet conduit being pliable, said outlet conduit receiving a mixed solution of water and bathing gels such that the solution becomes generally homogenized upstream said outlet conduit;

means for regulating a quantity of the bathing gels such that the user may selectively adjust a bathing gel:water ratio within said housing; and means for displaying a remaining quantity of the bathing gels such that the user can readily identify whether said compartments require an additional supply of the bathing gels;

wherein said regulating means comprises:

a pair of rotatable knobs protruding outwardly from said compartments and being selectively rotatable between on and off positions;

a pair of flow valves operably connected to said knobs wherein each said valve is provided with an axial bore passing therethrough such that said valves define a continuous travel path downwardly through said compartments when the user rotates said knobs to the open position, said axial bores being disposed horizontally and thereby restricting the flow of the bathing gels downwardly through said compartments when the user rotates said knob to the off position; and a plurality of chamfered gates disposed subjacent said valves wherein each said chamfered gate can be selectively positioned along a pair of vertical planes extending substantially parallel to the axis such that a discharge rate of the bathing gels can be controlled within said compartments and selectively introduced into the water stream prior to exiting said housing.

6. The apparatus of claim 5, wherein each said compartment is provided with an open lower edge portion medially facing the longitudinal axis, said chamfered gates being slidably positional along said open lower edge portions;

said regulating means further comprising a pair of levers extending outwardly from said compartments and operably connected to said chamfered gates such that the user may readily adapt said chamfered gates between maximum and minimum positions.

7. The apparatus of claim 5, wherein said identifying means comprises: a plurality of transparent windows fitted into an outer wall of said compartments and extending along a vertical plane such that the user may readily determine a remaining quantity of the bathing gels housed within said compartments.

8. The apparatus of claim 5, wherein said outlet conduit comprises: a dispensing nozzle removably attached thereto, said dispensing nozzle having a plurality of spaced openings sized and shaped for allowing the homogonous solution to effectively exit said dispensing nozzle and thereby limit the likelihood of clogging said openings between repeated uses.

9. An apparatus removably attachable to a water supply source for allowing a user to receive a stream of water mixed with at least one bathing gel, said apparatus comprising:

a inlet conduit having a threaded coupling attached to a top end portion thereof and being removably attachable to the water supply source, said inlet conduit extending along a rigid path wherein a selected volume of water flows downstream therethrough;

a housing integrally connected to said inlet conduit and including a plurality of spaced compartments for storing alternate bathing gels, said housing further having a centrally disposed longitudinal axis bisecting said inlet conduit wherein said compartments are equidistantly spaced laterally away from the axis to thereby allow a stream of water to flow medially between said compartments prior to exiting said housing, each said compartments further including an inlet port formed along a top surface thereof for receiving the bathing gels therethrough, each said inlet port being provided with a fitted end cap removably positional thereon for isolating said compartments from undesirable foreign elements during operating conditions;

an outlet conduit attached to a lower portion of said housing, said outlet conduit being pliable, said outlet conduit receiving a mixed solution of water and bathing gels such that the solution becomes generally homogenized upstream said outlet conduit;

means for regulating a quantity of the bathing gels such that the user may selectively adjust a bathing gel:water ratio within said housing; and means for displaying a remaining quantity of the bathing gels such that the user can readily identify whether said compartments require an additional supply of the bathing gels;

wherein each said compartment further including a plurality of seals attached therein such that said seals cooperate with a regulating means for limiting undesirable leakage of the bathing gels.

10. The apparatus of claim 9, wherein said regulating means comprises:

a pair of rotatable knobs protruding outwardly from said compartments and being selectively rotatable between on and off positions;

a pair of flow valves operably connected to said knobs wherein each said valve is provided with an axial bore passing therethrough such that said valves define a continuous travel path downwardly through said compartments when the user rotates said knobs to the open position, said axial bores being disposed horizontally and thereby restricting the flow of the bathing gels downwardly through said compartments when the user rotates said knob to the off position; and a plurality of chamfered gates disposed subjacent said valves wherein each said chamfered gate can be selectively positioned along a pair of vertical planes extending substantially parallel to the axis such that a discharge rate of the bathing gels can be controlled within said compartments and selectively introduced into the water stream prior to exiting said housing.

11. The apparatus of claim 10, wherein each said compartment is provided with an open lower edge portion medially facing the longitudinal axis, said chamfered gates being slidably positional along said open lower edge portions;

said regulating means further comprising a pair of levers extending outwardly from said compartments and operably connected to said chamfered gates such that the user may readily adapt said chamfered gates between maximum and minimum positions.

12. The apparatus of claim 10, wherein said identifying means comprises: a plurality of transparent windows fitted into an outer wall of said compartments and extending along a vertical plane such that the user may readily determine a remaining quantity of the bathing gels housed within said compartments.

13. The apparatus of claim 9, wherein said outlet conduit comprises: a dispensing nozzle removably attached thereto, said dispensing nozzle having a plurality of spaced openings sized and shaped for allowing the homogonous solution to effectively exit said dispensing nozzle and thereby limit the likelihood of clogging said openings between repeated uses.

* * * * *